United States Patent [19]

Hawes

[11] 4,211,514

[45] Jul. 8, 1980

[54] MIXED FLOW FAN

[75] Inventor: Stanley P. Hawes, Walton-on-Thames, England

[73] Assignee: Airscrew Howden Limited, Weybridge 2, England

[21] Appl. No.: 860,650

[22] Filed: Dec. 14, 1977

[30] Foreign Application Priority Data

Dec. 22, 1976 [GB] United Kingdom ..... 53468/76

[51] Int. Cl.[2] ..... F04D 29/44

[52] U.S. Cl. ..... 415/191; 415/213 C

[58] Field of Search ..... 415/183, 213 C, 185, 415/191, 199.4, 207

[56] References Cited

U.S. PATENT DOCUMENTS 2,609,141 9/1952 Ave ..... 415/211

3,147,541 9/1964 Hathaway ..... 29/156.8

3,204,863 9/1965 Hausammann ..... 415/183

FOREIGN PATENT DOCUMENTS 1328082 8/1973 United Kingdom ..... 415/183

OTHER PUBLICATIONS

Wallis, R. A., *Axial Flow Fans, Design and Practice,* London, George Newnes Ltd., 1961, p. 9.

*Primary Examiner*—Louis J. Casaregola

*Attorney, Agent, or Firm*—Sughrue, Rothwell, Mion, Zinn and Macpeak

[57] ABSTRACT

A mixed flow fan is described having inlet guide vanes which impose on air entering the fan a swirl in a direction opposite to the fan's rotation. The application of such a fan to automotive cooling is described.

3 Claims, 14 Drawing Figures

MIXED FLOW FAN

This invention relates to fans and more especially, but not exclusively, to mixed flow fans.

BACKGROUND OF THE INVENTION

A mixed flow fan before the invention of our British Patent No. 1328032 has been understood to comprise a bladed impeller which takes air from an inlet and discharges it with axial and radial components as well as a whirl (or circumferential) component, into a casing which leads the air to an outlet. Some of the kinetic energy of the air leaving the impeller is converted to pressure in the casing.

The invention of our patent 1328082 is a mixed flow fan having an impeller comprising a series of blades supported on a generally frusto-conical central portion, which impeller discharges directly into the ambient atmosphere or a plenum chamber.

The term mixed flow fan as used in the following description is understood to comprise both the fan with direct-discharging impeller of our patent 1328082, and the conventional fan with diffuser casing.

SUMMARY OF THE INVENTION

The present invention in one aspect comprises a mixed flow fan with inlet guide vanes to impose on air entering the fan a swirl in a direction opposite to the fan's rotation. Ideally the vanes would be designed to eliminate swirl in air leaving the impeller; the invention, however, includes fans where outlet swirl is reduced but not completely eliminated. The effect of reducing outlet swirl is to increase fan efficiency and enable improved performance by allowing it to absorb more input power at a given rotational speed. Also, in conventional fans reducing outlet swirl helps towards even flow distribution and minimises pressure loss in any duct system on the fan outlet.

Guide vanes could be provided at the outlet of the impeller to reduce outlet swirl for both direct-discharge and conventional fans, but would take up more space and would not allow the impeller to absorb extra power.

The inlet guide vanes may act as supports for a central bearing for the impeller, with the impeller being driven by any desired means, such as a belt on the inlet side. Alternatively the impeller may be mounted on a drive shaft independently of the guide vanes.

The invention in a second aspect comprises a mixed flow fan having its impeller discharging directly into a partially open compartment containing an internal combustion engine, the air flow serving to cool the engine directly and/or, in the case of a liquid-cooled engine to cool a heat exchanger for the liquid. The compartment may be the under-cab or under-bonnet area of a motor car or truck. The fan will discharge into virtually ambient air conditions, or into plenum chamber conditions, i.e. against some distinct, though small, back pressure, depending on circumstances of design.

The mixed flow fan, in the combination just mentioned, will preferably have the swirl-reducing inlet blades referred to above. The mixed flow fan has the advantage in this combination that it can produce the required air flow at a lower rotational speed than the corresponding axial fan, and thus with less noise. A cross flow fan with ducted outlet would be too bulky to contemplate in an automotive environment, and the outlet disposition would present problems.

The invention will be further described with reference to, but without limitation by, the accompanying drawings.

DESCRIPTION OF PREFERRED EMBODIMENT

Figure 1:
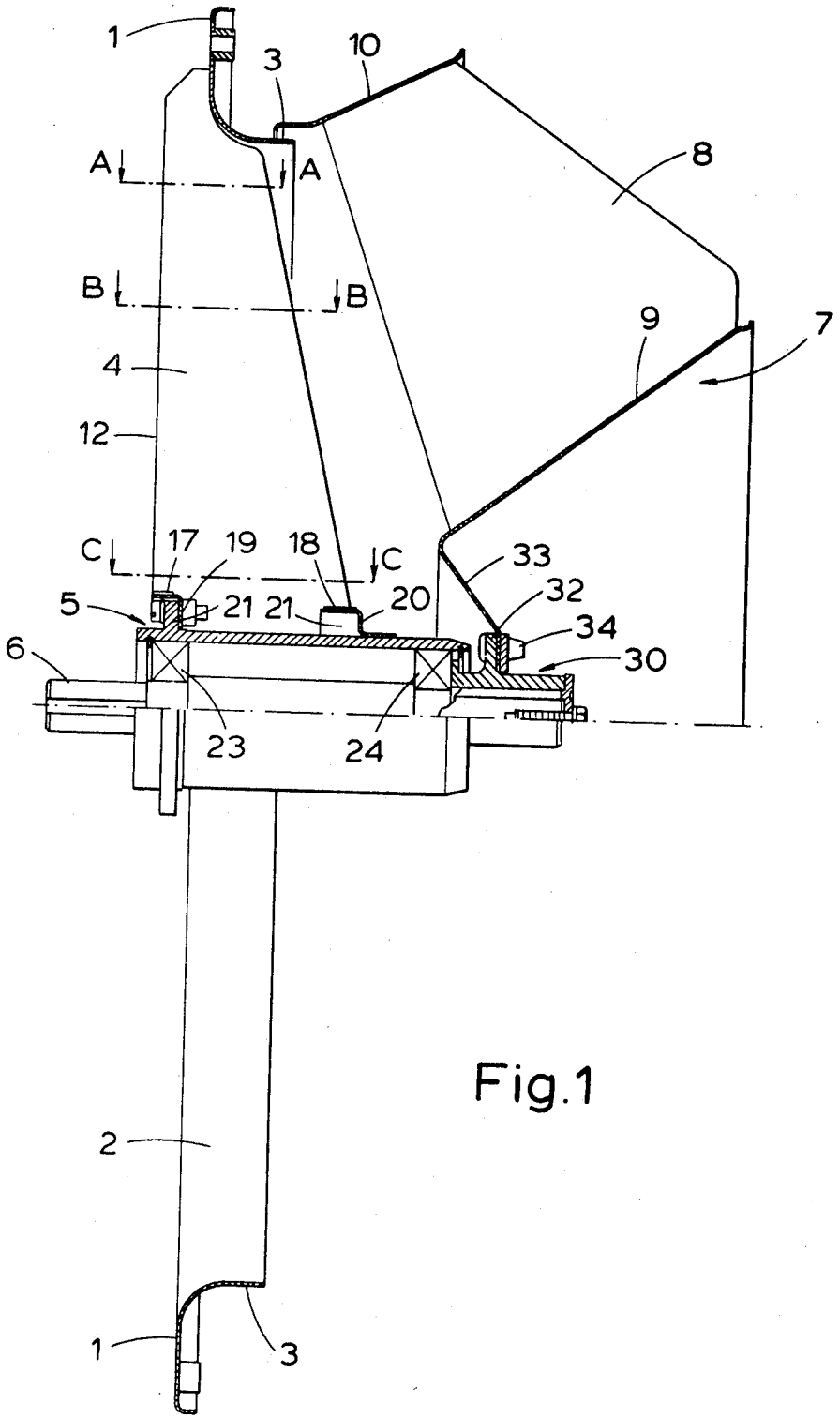
FIG. 1 is a longitudinal sectional view of a mixed flow fan according to the invention, parts of the fan being removed for clarity below the centre line.
Figure 2:
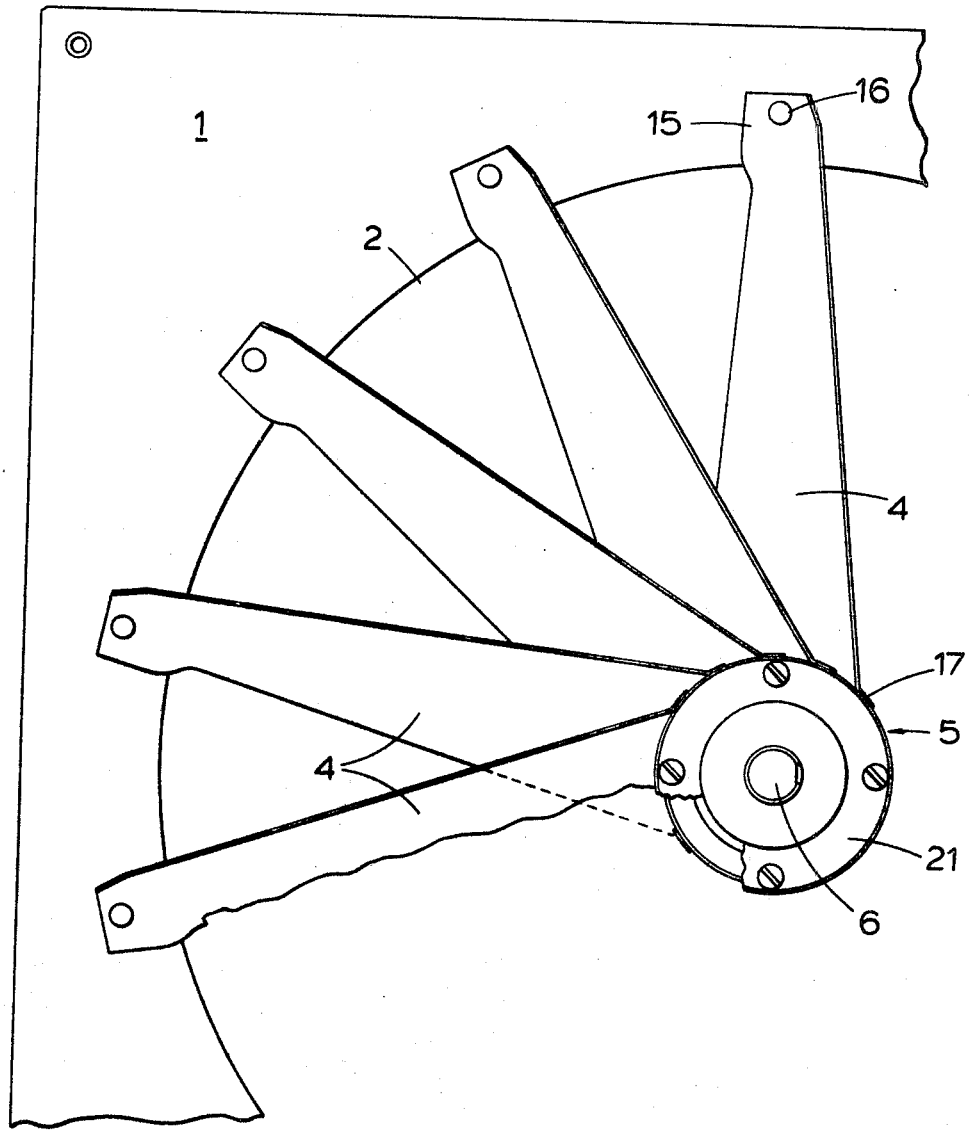
FIG. 2 is a front view of the FIG. 1 fan again with portions omitted.

The fan illustrated in FIGS. 1 to 4 comprises a square mounting plate 1 with a circular inlet opening 2. The annular area around the opening 2 is smoothly curved towards the rear where it terminates in a cylindrical portion 3. A series of similar uniformly spaced inlet vanes 4, to be described in detail later, are secured at one end to the mounting plate 1 around the opening 2 and extend radially inward to support a hub structure 5 on the axis of the opening.

Figure 5:
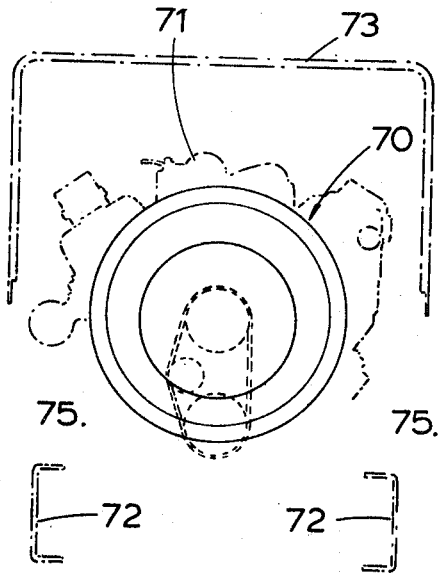
FIGS. 5, 6 and 7 are diagrams showing respectively two end views and a side view of one arrangement in which a fan according to the invention is mounted in the engine compartment of a truck.

A shaft 6 mounted on the hub structure 5 supports an impeller designated generally 7 and comprising a series of rearwardly curved blades 8 between inner and outer shroud rings 9, 10, the outer shroud ring 10 at its inlet end surrounding the cylindrical portion 3. Drive may be provided to the shaft 6, for example by a belt to a pulley keyed to the projecting front end of the shaft: such a drive arrangement is shown in FIG. 5.

Figure 3A:
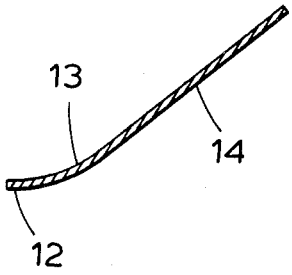
FIGS. 3*a*, 3*b* and 3*c* are sections of an inlet vane at three points along its length indicated at A-A, B-B and C-C in FIG. 1.
Figure 3B:
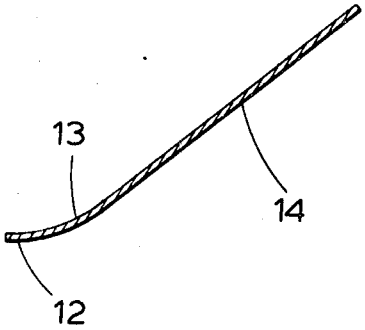
Figure 3C:
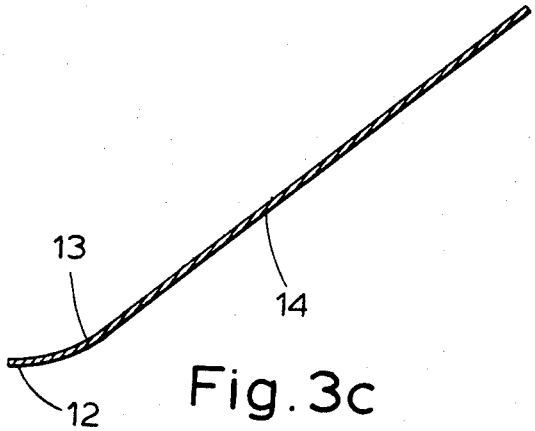
Figure 4A:
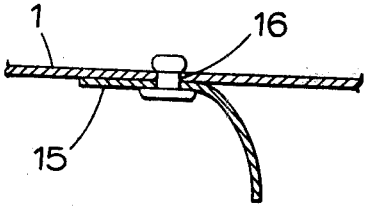
FIGS. 4*a* and 4*b* are scrap views showing the fixing the ends of the inlet vanes.
Figure 4B:
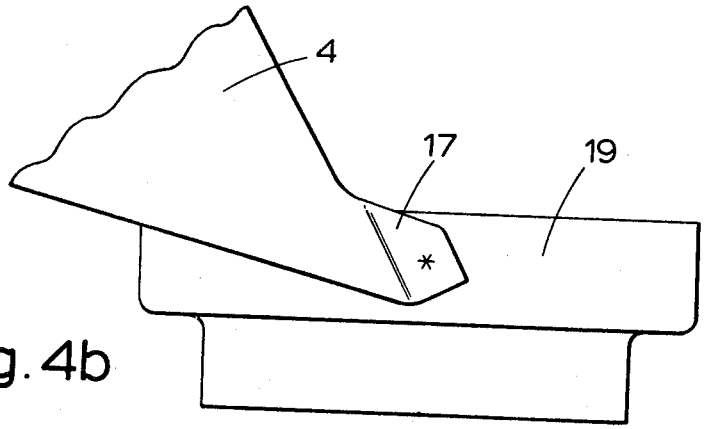

The inlet vanes 4 are of gradually increasing depth as they approach the axis, as will be seen in FIGS. 3*a*, 3*b* and 3*c*. The inlet edge portion 12 of each vane 4 lies virtually on an axial plane, and is followed by a curved portion 13 which in turn is followed by a straight portion 14 extending towards the trailing edge. The outer end of each inlet vane 4 is bent to lie flat against the front of the mounting plate 1, as shown at 15, and is secured in position by a rivet (not shown) in a rivet hole 16. The inner end of each inlet vane has a pair of ears 17, 18. The forward ear 17 is bent to overlie a forward mounting ring 19 forming part of the hub structure 5, and is spot-welded thereto. Similarly, at the trailing edge of the vane 4 the ear 19 is secured to a mounting ring 20. The mounting rings overlie, and are secured to, annular flanges 21 on a tube 22 within which ball-bearings 23, 24 are mounted at either end to carry the shaft 6.

The rear end of the shaft 6 protrudes beyond the rear bearing 24 to carry an impeller hub 30 keyed to the shaft and having a radial flange 32. The inner shroud ring 9 of the impeller 7 is, at its inner end, bent back as shown at 33 and bolted to the flange 32 by bolts 34.

The inlet vanes 4 are directed so as to cause a pre-swirl in the inlet air opposite in direction to the direction of rotation of the impeller. This pre-swirl is designed to eliminate swirl at the outlet from the impeller 7, with the advantages above mentioned.

Figure 6:
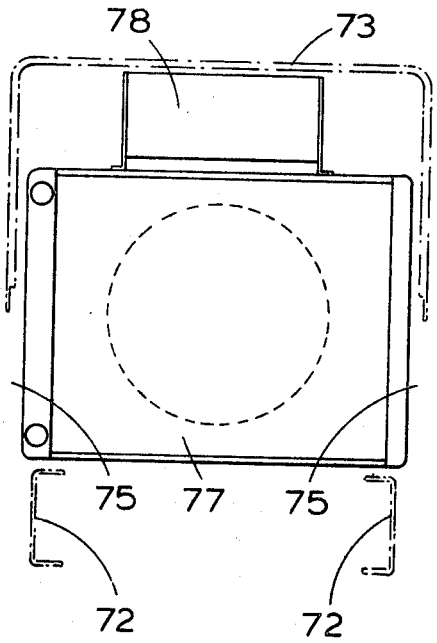
Figure 7:
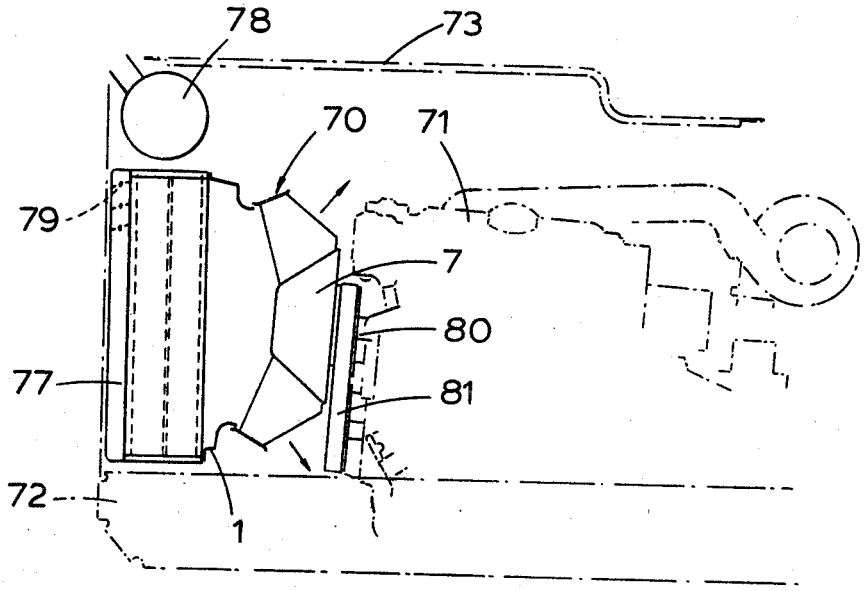

Turning now to FIGS. 5, 6 and 7 a fan such as shown in FIG. 1 is here illustrated applied to the cooling of a truck engine shown schematically at 71. The fan 70 is shown only diagrammatically. The engine is mounted by means not shown on spaced apart longitudinal chassis members 72. A cover 73 extends over the top of the engine with generous clearance, and halfway down the sides, leaving a gap at each side. The arrangement provides for escape of cooling air through the gap 74 between the chassis members 72 and through the gaps 75 above and at either side. At the front of the engine compartment is a radiator 77 surmounted by a header tank 78. On the inlet side of the radiator a series of louvres 79 are pivotally mounted to be opened and closed as a group of thermostatic means responsive to the temperature of the radiator fluid. The fan impeller 7 is coupled directly to an engine shaft 80, driven by a belt 81 from the engine crankshaft. The engine is shown inclined front to rear and the fan inlet plate 1 surrounding the impeller 7 is adjusted to lead air from the radiator 77 whose axis is horizontal to the impeller 7 whose axis is at a slight angle to the horizontal.

Figure 8:
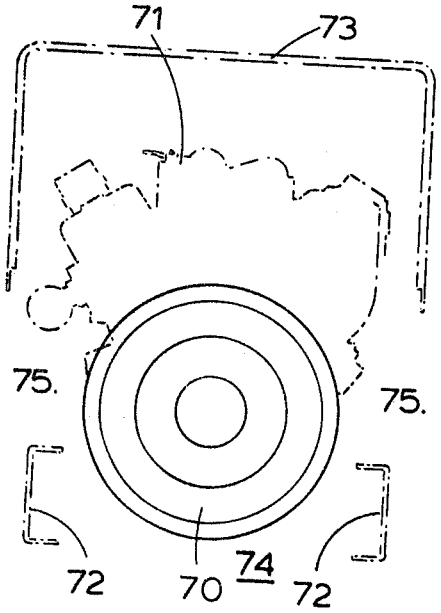
FIGS. 8, 9 and 10 are diagrams generally similar to FIGS. 5, 6 and 7 but showing a different arrangement of fan and engine.
Figure 9:
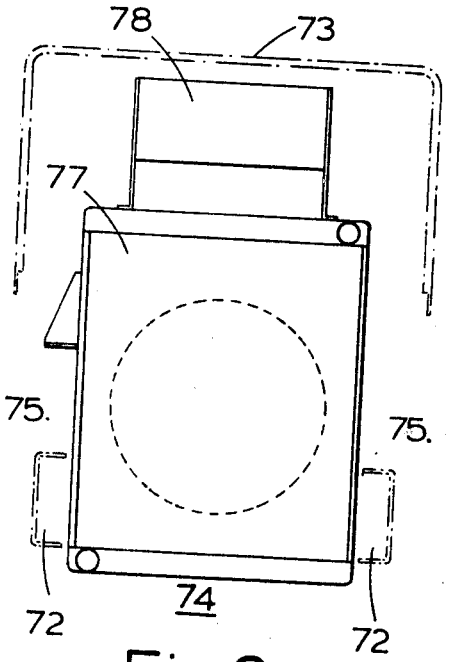
Figure 10:
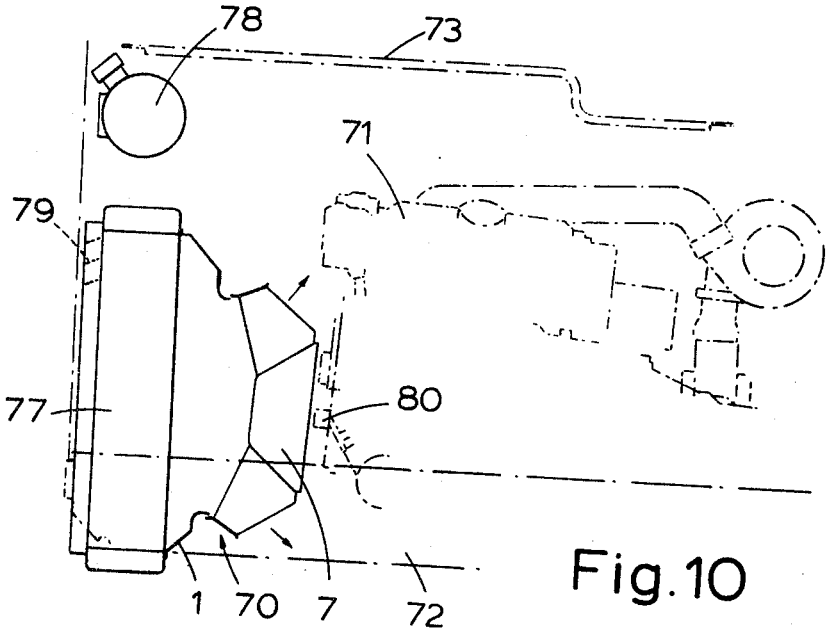

FIGS. 8, 9 and 10 show a similar arrangement where the fan is mounted somewhat lower and coupled direct to the engine crankshaft. Similar parts are given the same reference numbers.

Figure 11:
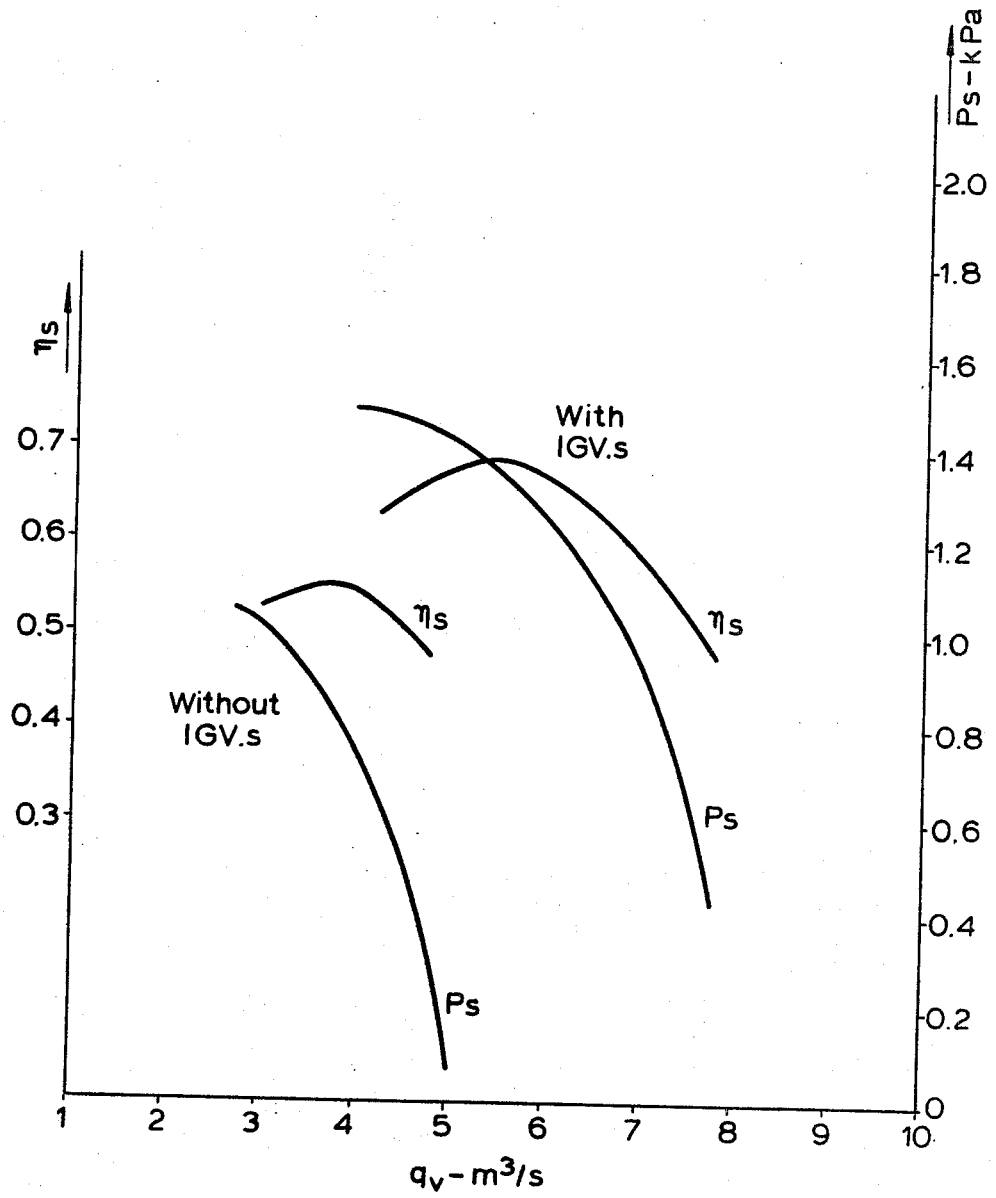
FIG. 11 is a graph showing a family of curves illustrative of the performance of the fan of FIGS. 1 to 4.

FIG. 11 illustrates the performance of the fan of FIGS. 1 to 4 (curves marked "with IGV's) compared with a similar mixed flow fan without the flow-deflecting inlet guide vanes (curves marked "without IGV's). In the second fan it is to be assumed that the central bearing is supported by radial members that do not deflect flow.

For each fan pressure ps and efficiency$\eta$ are plotted against fan throughput. The superiority of the fan with inlet guide vanes will be apparent.

Various changes can be made in the apparatus illustrated. For example, in the FIGS. 1 to 4 fan the inlet portion 3 can be slightly conical or curved instead of cylindrical as shown. The inlet guide vanes 4 may be shaped so that their depth increases going outwardly, instead of the other way: this would be preferable from an aerodynamic point of view. The blade shape illustrated is designed for easy manufacture from sheet material, and if the blades were cast, whether of plastics or metal, an airfoil shape would be preferred.

The fan can be driven from a central motor as shown in our British Pat. No. 1328082.

The inlet guide vanes could be designed for stamping from a single plane sheet of metal.

The inlet guide vanes could be designed as a separate unit for attachment to existing fans.

While the fan of FIGS. 1 to 4 is shown designed for construction in sheet metal, those skilled in the art will appreciate that the design could be modified for construction in cast metal (e.g. aluminium or magnesium alloy) or in moulded plastics. In some cases a mixed construction may be preferred with, say, the rotor of cast aluminium, and other parts of sheet metal.

In both examples shown, where the fan of FIGS. 1 to 4 is combined with an internal combustion engine, the fan will be about the same diameter as a corresponding axial fan of the usual prior art construction, but the rotational speed will be much less, say 70% of the axial fan speed. Despite the slower speed, the mixed flow fan provides the same performance as the prior art axial fan. This speed reduction enables a large reduction of noise: in a typical installation the reduction may be of the order of 10 dB at full speed. Also, as shown in FIGS. 8, 9 and 10, the fan can be driven direct from the crankshaft.

In one automotive construction according to FIGS. 8, 9 and 10, with a diesel engine of 300 horsepower driving automatic transmission, a 5 square foot radiator was used, transferring 10,000 B.Th.U.'s per minute with ambient air at 125° F. The fan was driven at engine speed. At 2,300 r.p.m. the fan gave a throughput of 11,400 cubic feet per minute at 2 inch water gauge pressure, consuming 10 horsepower. The sound power level was 102 decibels. A comparable axial fan of the prior art would be driven at a higher speed, consume about double the horsepower, and give a sound power level 10 dB higher.

I claim:

1. A mixed flow unducted direct discharge fan comprising:

(a) a direct discharging mixed flow rotor,
(b) a support ring,
(c) bearing support means for the rotor,
(d) a plurality of vanes positioned to extend between support ring and the bearing support means,
(e) the vanes being angled to impose on air entering the fan a swirl in the opposite direction to swirl produced by the rotor in operation.

2. A mixed flow unducted direct discharge fan as claimed in claim 1 wherein the guide vanes are angled at their trailing edges to impose on the air entering the fan a swirl opposite in direction to the swirl produced by the rotor such that the air being directly discharged from the fan is substantially without swirl.

3. A mixed flow unducted direct discharge fan as claimed in claim 1 wherein the rotor has backwardly curved blades.

* * * * *